US005488885A

United States Patent [19]

Byers et al.

[11] Patent Number: 5,488,885

[45] Date of Patent: Feb. 6, 1996

[54] SHARPENING AND DEBURRING TOOL WITH BLADE GUIDE

[76] Inventors: Gary L. Byers; Timothy W. Byers, both of P.O. Box 550, Whitefish, Mont. 59937

[21] Appl. No.: 285,706

[22] Filed: Aug. 4, 1994

[51] Int. Cl.[6] ..... B21K 11/00

[52] U.S. Cl. ..... 76/86

[58] Field of Search ..... 76/82, 86–89; 51/486, 557, 558

[56] References Cited

U.S. PATENT DOCUMENTS 4,599,919 7/1986 Fortenberry ..... 76/86

*Primary Examiner*—Douglas D. Watts
*Attorney, Agent, or Firm*—Harry M. Cross, Jr.

[57] ABSTRACT

A hand-held sharpener tool for a knife or similar implement comprises a unitary body having first and second sections; sharpening elements mounted in the first section; the second section being located rearwardly of the sharpening elements and comprising an elongated handle on an upper side of the body, an elongated hand guard extending rearwardly of the sharpening elements, and a blade guide located on a lower side of the body, the hand guard being located between the handle and the blade guide whereby sufficient space is provided for a user's fingers to extend between the handle and the hand guard.

6 Claims, 3 Drawing Sheets

SHARPENING AND DEBURRING TOOL WITH BLADE GUIDE

FIELD OF THE INVENTION

This invention relates to hand tools and, more particularly, to hand held sharpening and deburring tools.

BACKGROUND OF THE INVENTION

Hand held sharpening and deburring tools have been proposed for home, business, sports, commercial and industrial uses for convergent-edged bladed implements, such as knives, cleavers, hatchets, and the like kind of implements having V-shaped working edges. Hand held tools of this type have been proposed that can accommodate like-structured devices, such as knife-type blades, where sharpening or deburring must occur on two convergent surfaces, and such tools have incorporated hand and finger guards. An exemplary model is disclosed in U.S. Pat. No. 4,418,588 that incorporates a cantilevered guard designed to shield a user's fingers from the blade being sharpened as the tool is drawn along the blade edge. In tools of the type disclosed in U.S. Pat. No. 4,418,588, there is no blade guide to align the blade with the overlapped carbide sharpening inserts in the tool's sharpening/deburring section. Therefore, a user must self-align the blade while drawing the tool along the blade edge. This lack of a blade guide causes some user's to be concerned whether they may inadvertently cut themselves when the tool is pulled off the tip of the blade. This concern has resulted in a limiting of the attractiveness of such tools to certain potential users.

SUMMARY OF THE INVENTION

A primary object of the present invention is to provide a hand-held sharpening/deburring tool of the type having a unitary body with a blade guide and a finger/hand guard and that incorporates overlapped carbide sharpening/deburring elements.

The hand-held sharpener tool of this invention comprises sharpening means, means for mounting the sharpening means, handle means for gripping the tool so as to apply the sharpening means to a blade to be sharpened, hand guard means for shielding a user's tool-gripping hand, and blade guide means for receiving a blade to be sharpened, the blade guide means being constructed and arranged whereby the tool may be placed on the blade and drawn along the blade with the blade guide means guiding the blade into the sharpening means and with the hand guard means shielding the user's tool-gripping hand as the tool is drawn along the blade. The tool preferably comprises a unitary body having a front end section mounting the sharpening means, and a main section incorporating the handle means, the hand guard means, and the blade guide means. In the preferred form of the tool body, the body provides a ring section that incorporates the handle means and the hand guard means, with the hand guard means located between the handle means and the blade guide means. The tool's blade guide means provides an elongated notch for receiving the blade to be sharpened, the base of the notch being adjacent the handle guard means.

The tool body is provided with recesses in a first frontal section thereof to receive sharpening and/or deburring inserts and a second section located longitudinally rearwardly of the first frontal section. The recesses are adapted to receive a first insert member in a generally longitudinal position with respect to the longitudinal axis of the body that extends toward a front edge of the first frontal section, and to receive a second insert member in a generally longitudinal position with respect to the longitudinal axis of the body that extends toward the front edge of the first frontal section. A plurality of sharpening and/or deburring insert members are positioned within the body recesses. These insert members comprise a first insert member, having a ground surface providing at least one sharpening and/or deburring edge, that is positioned within the body recesses such that its ground surface is oriented toward the outer end of the frontal section at an obtuse angle with respect to the longitudinal axis of the body; and a second insert member, having a ground surface providing at least one sharpening and/or deburring edge, that is positioned within the body recesses such that it partially overlays the second insert member in abutting contact therewith and such that its ground surface is oriented at an obtuse angle with respect to the longitudinal axis of the body. The ground surfaces of the first and second insert members are convergent whereby an object to be sharpened or deburred may be inserted between the convergent ground surfaces for sharpening and/or deburring. Insert retaining means may be detachably secured to the body and adapted to contact one of the insert members and to apply a sufficient force to that insert member whereby the first and second insert members are restrained from movement within the body recesses.

DETAILED DESCRIPTION OF THE INVENTION

Figure 1:
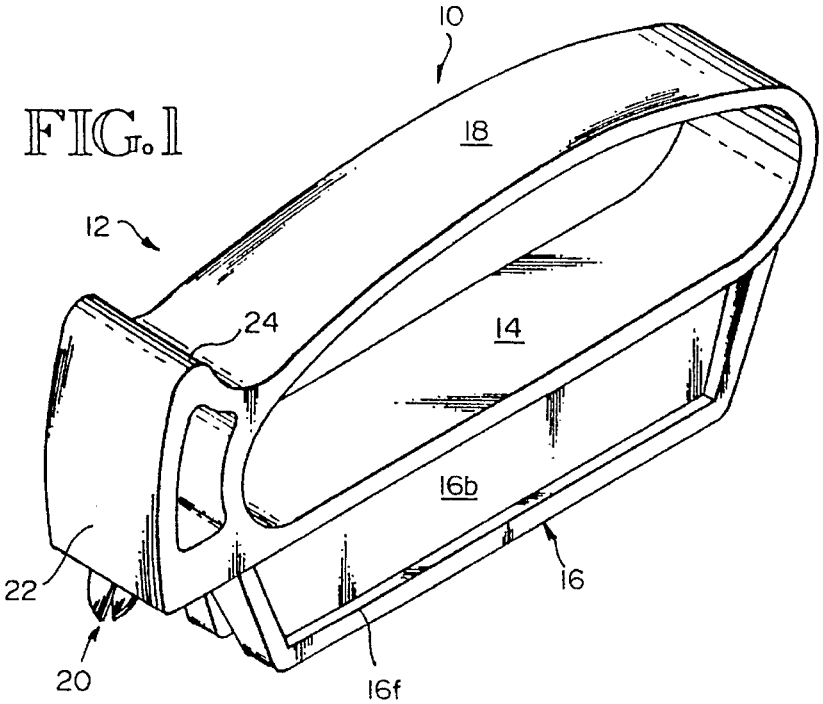
FIG. 1 is a perspective view of the hand held sharpener/deburrer of this invention.
Figure 2:
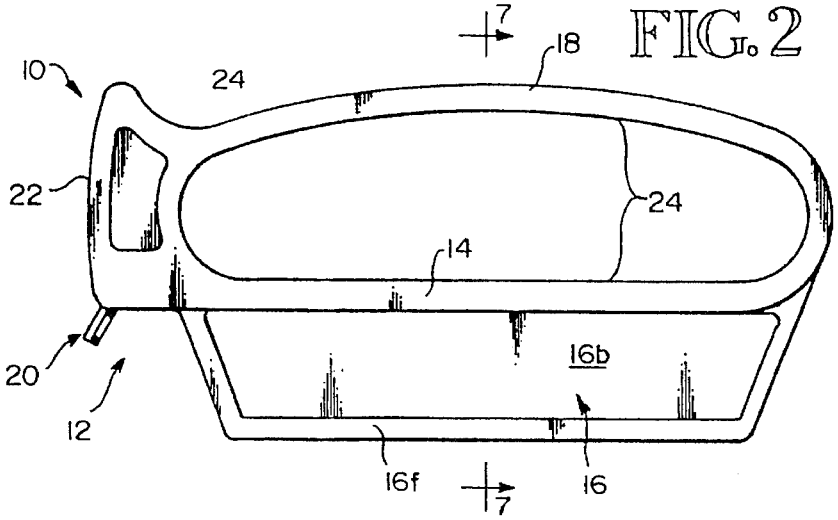
FIG. 2 is a side elevation view of the FIG. 1 tool.

The hand held sharpening/deburring tool 10 of this invention comprises (a) a unitary body 12 having a hand/finger guard section 14, a blade guide section 16, and a handle grip section 18; and (b) sharpening/deburring insert members 20 fastened to the body 12. The front end section 22 of body 12 mounts the insert members 16 and also provides a thumb rest 24 above the insert mounting. Thus, the insert mounting and the thumb rest are located forwardly of the handle grip section 18, the blade guide section 16, and the hand/finger guard section 14.

Figure 8:
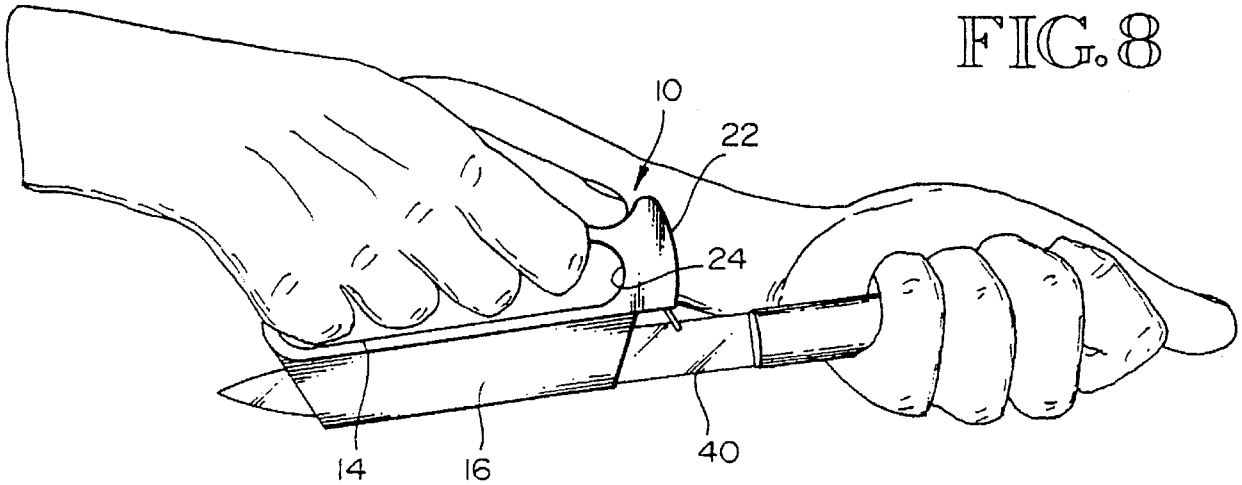
FIG. 8 is a perspective view of the FIG. 1 tool illustrating its use in sharpening a knife blade with the tool applied to the knife blade with the blade tracking in the blade guide.
Figure 7:
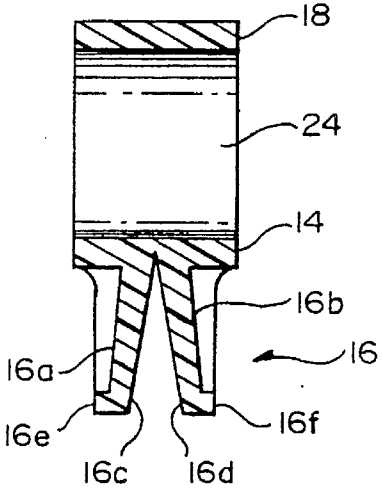
FIG. 7 is a cross-section view taken along the line 8—8 of FIG. 2.

The main part of the body 12 is formed as a flattened ring, longitudinally elongated. The upper part of this flattened ring provides the handle grip section 18 and the bottom part provides the hand/finger guard section 14. The handle grip section 18 and the hand/finger guard section 14 are generally rectangular in cross-section as can be seen in FIG. 7. The interior 24 of this flattened ring is long enough and high enough to accommodate a user's fingers when the user wraps his/her fingers around the upper part in a gripping fashion. Gripping the ring thusly naturally places the user's thumb on the thumb rest 24, and the bottom part naturally forms the finger/hand guard as can be seen in FIG. 8.

The blade guide section 16 depends from the finger/hand guard section 14. Section 16 comprises a pair of depending walls 16*a*, 16*b* that have interior, facing surfaces 16*c*, 16*d* that are upwardly convergent (i.e. surfaces 16*c*, 16*d* are inverted V-shaped in cross-section as can be seen in FIG. 7). The periphery of each wall, 16*a*, 16*b*, is rimmed with an laterally-outward extending reinforcing edge, 16*e*, 16*f*, and the walls consist of webs extending between the finger/hand guard 14 and the reinforcing edges 16*e* (in the case of wall 16*a*), 16*f* (in the case of wall 16*b*).

Figure 3:
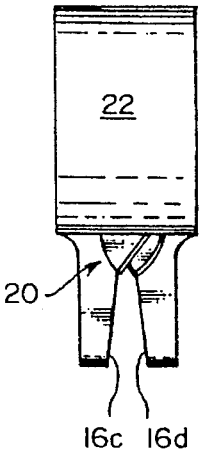
FIG. 3 is a front end view of the FIG. 1 tool further illustrating the placement of the preferred overlapped carbide sharpening/deburring elements.

The sharpening/deburring inserts 20 are rectangularly shaped flat members made of appropriate material such as tungsten carbide or the like. Each blade has a ground face to be employed in a sharpening/deburring process. With respect to inserts 20 the ground faces are intersected and overlayed as shown to provide convergent sharpening/deburring working edges that define a V-shaped notch. The ground faces of inserts 20 may be beveled at about 5 degrees so that the faces themselves lie in convergent planes. Therefore, the cutting edge of a knife or like device may be rested upon the working edges of inserts 20 and tool 10 drawn therealong to sharpen or deburr the cutting edge. The outside front corners of inserts 20 may be rounded as shown in FIG. 3.

The inserts 20 are received in overlying abutting relationship and held in such relationship as a result of being secured within the body 12. This may be accomplished by molding the body 12 around the inserts or by fastening the inserts into a slot provided in the body 12. If it is desired to make the inserts replaceable, the front end section 22 could be appropriately modified to accommodate an insert retainer that would detachably secure the inserts to the front end section 22. Such an insert retainer could be formed to position and hold the inserts 20 in the proper overlapped and aligned position shown in the drawings.

Figure 4:
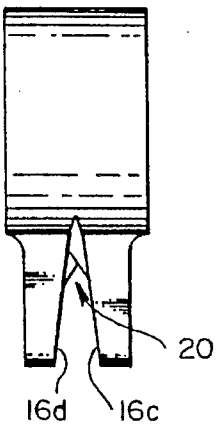
FIG. 4 is a rear end view of the FIG. 1 tool further illustrating the blade guide notch in relation to the overlapped sharpening/deburring elements.
Figure 5:
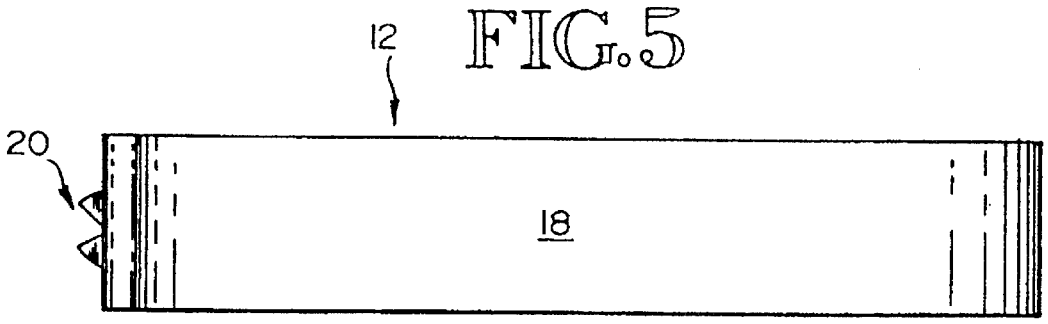
FIG. 5 is a top plan view of the FIG. 1 tool.
Figure 6:
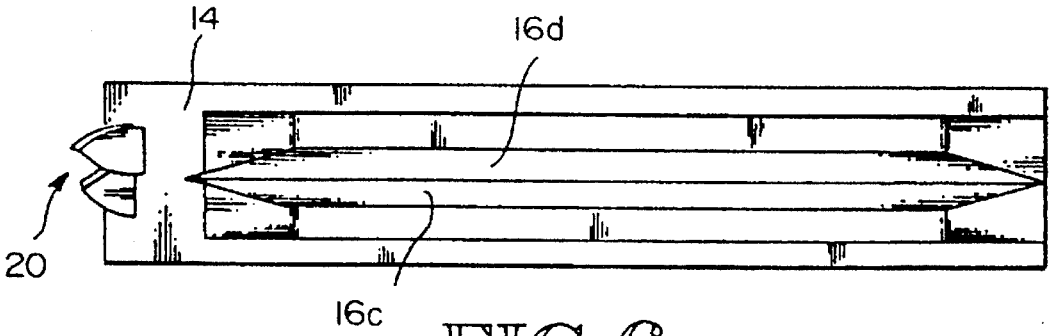
FIG. 6 is a bottom plan view of the FIG. 1 tool.

When in use, the tool 10 is placed over a blade, such as knife blade 40 in FIG. 8, with the webs 16*a*, 16*b* of the blade guard 16 disposed on either side of the blade 40. As can be seen in FIG. 4, the inverted V-shaped notch of the blade guide will guide the blade edge into the proper relationship with the inserts 20 for sharpening/deburring. The V-shaped notch, defined by the inner surfaces 16*c*, 16*d* of the webs 16*a*, 16*b*, is longitudinally elongated, underlying and extending substantially the full length of the flattened ring of body 12. The bottom of the notch is located at base of the finger/hand guard 14 so that the knife blade edge will be guided longitudinally through the sharpening/deburring inserts 20, just below the finger/hand guard 14. The inserts 20 extend forwardly and outwardly at an obtuse angle from the front end section 22 so that they will form an acute angle with respect to the blade edge to be sharpened/deburred, also as shown in FIG. 8. In operation, the blade being sharpened/deburred is shielded from the user's hand and, when the tool is pulled beyond the tip of the blade, the front end section 22 continues to shield the user's knuckles and thumb.

A preferred tool 10 is fabricated from injection-molded plastic, with a width of about 0.75 in., a length of about 4.24 in. and a height of about 2 in. The inverted V-shaped notch of the blade guide has a depth of about 0.75 in. The thickness of the rim of the flattened ring is about 1/8 in. and the thickness of the blade guide webs is also about 1/8 in.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A hand-held sharpener tool for sharpening blades which comprises sharpening means; handle means mounting said sharpening means in a front end section of said tool and providing an elongated handle grip section extended rearwardly from said front end section and so constructed that a user's fingers may be wrapped therearound for gripping said tool so as to apply said sharpening means to a blade to be sharpened; hand guard means extended from said front end section to a rear end of said tool for shielding a user's tool-gripping hand; and blade guide means extended between said front end section and said rear end;

said blade guide means being constructed and arranged to provide a blade-receiving channel juxtaposed to said sharpening means and extended along said hand guard means so that a blade to be sharpened can be placed in said blade-receiving channel so as to locate the blade relative to said sharpening means and confine the blade as said tool is drawn along the blade; and said blade guide means and said hand guard means being constructed and arranged to locate said hand guard means between said handle grip section and said blade-receiving channel so that a user's fingers may be wrapped around said handle grip section with the tool-gripping hand being separated from said blade-confining channel by said hand guard means when said tool is applied to a blade to be sharpened and the blade is drawn through said sharpening means and through said blade-receiving channel.

2. The tool of claim 1 wherein said tool comprises a unitary body having said front end section mounting said sharpening means, and having a main section incorporating said handle means, said hand guard means, and said blade guide means.

3. The tool of claim 2 wherein said body provides an enclosed ring section that incorporates said handle means and said hand guard means, said handle means and said hand guard means being further constructed and arrange so that an elongated ring interior is defined having a length and height sufficient to accommodate a user's fingers when a user grips said handle grip section.

4. The tool of claim 3 wherein said blade guide means provides said blade-receiving channel in the form of an elongated v-shaped notch for receiving a knife-type blade to be sharpened, the base of said notch being adjacent said handle guard means.

5. A hand-held sharpener tool which comprises a unitary body having first and second sections; sharpening means mounted in said first section; said second section being located rearwardly of said sharpening means and comprising an elongated handle on an upper side of said body, an elongated hand guard extending rearwardly of said sharpening means, and a blade guide located on a lower side of said body, said hand guard being located between said handle and said blade guide whereby sufficient space is provided for a user's fingers to extend between said handle and said hand guard, and said blade guide comprising a pair of walls connected to and extended downward from said hand guard so as to define an elongated and inverted blade-receiving channel that underlies said hand guard; the walls of said blade guide having sloped inner surfaces that define an elongated and inverted V-shaped blade-receiving notch, the base of said notch being adjacent said hand guide, and wherein said walls are provided with peripheral edge-reinforcing rims extended therearound and terminated in said hand guard so that said walls constitute webs extended from said hand guard that are bounded by said rims.

6. A hand-held sharpener tool which comprises a unitary body having first and second sections; sharpening means mounted in said first section; said second section being located rearwardly of said sharpening means and comprising an elongated handle on an upper side of said body, an elongated hand guard extending rearwardly of said sharpening means, and a blade guide located on a lower side of said body, said hand guard being located between said handle and said blade guide whereby sufficient space is provided for a user's fingers to extend between said handle and said hand guard, and said blade guide comprising a pair of walls connected to and extended downward from said hand guard so as to define an elongated and inverted blade-receiving channel that underlies said hand guard; said handle and said hand guard being connected to form a flattened ring having an elongated ring interior that has a length and height sufficient to accommodate a user's fingers when a user grips said handle grip section and through which a user may insert his/her fingers in order to grip said handle; the walls of said blade guide having sloped inner surfaces that define an elongated and inverted V-shaped blade-receiving notch, the base of said notch being adjacent said hand guide, and wherein said walls are provided with peripheral edge-reinforcing rims extended therearound and terminated in said hand guard so that said walls constitute webs extended from said hand guard that are bounded by said rims.

* * * * *